US007478579B2

(12) United States Patent
Carberry et al.

(10) Patent No.: US 7,478,579 B2
(45) Date of Patent: Jan. 20, 2009

(54) ENCAPSULATED BALLISTIC STRUCTURE

(76) Inventors: John Carberry, 2914 Lake Forest Cir., Talbott, TN (US) 37877; John Garnier, 20 Christina Woods Ct., Newark, DE (US) 19702; Katherine Leighton, 217 Saturn Dr., Newark, DE (US) 19711

( * ) Notice: Subject to any disclaimer, the term of this patent is extended or adjusted under 35 U.S.C. 154(b) by 22 days.

(21) Appl. No.: 11/458,837

(22) Filed: Jul. 20, 2006

(65) Prior Publication Data

US 2008/0307953 A1 Dec. 18, 2008

(51) Int. Cl.
*F41H 5/02* (2006.01)
*F41H 5/04* (2006.01)

(52) U.S. Cl. ..... 89/36.02; 89/36.05

(58) Field of Classification Search ..... 89/36.02, 89/36.04, 36.05
See application file for complete search history.

(56) References Cited

U.S. PATENT DOCUMENTS 3,563,836 A * 2/1971 Dunbar ..... 428/44
3,616,115 A * 10/1971 Klimmek ..... 109/84
4,739,690 A 4/1988 Moskowitz
5,361,678 A * 11/1994 Roopchand et al. ..... 89/36.02
5,686,689 A 11/1997 Snedeker et al.
6,408,733 B1 * 6/2002 Perciballi ..... 89/36.02
6,510,777 B2 * 1/2003 Neal ..... 89/36.05
6,601,497 B2 8/2003 Ghiorse et al.
6,862,970 B2 * 3/2005 Aghajanian et al. ..... 89/36.02
6,899,009 B2 * 5/2005 Christiansen et al. ..... 89/36.02
6,995,103 B2 * 2/2006 Aghajanian ..... 501/88
7,069,836 B1 * 7/2006 Palicka et al. ..... 89/36.02
7,077,306 B2 * 7/2006 Palicka et al. ..... 228/170
2004/0216595 A1 * 11/2004 Dickson ..... 89/36.02
2005/0066805 A1 * 3/2005 Park et al. ..... 89/36.02
2006/0065111 A1 * 3/2006 Henry ..... 89/36.02
2006/0137517 A1 * 6/2006 Palicka et al. ..... 89/36.02
2006/0141237 A1 6/2006 Leighton et al.

* cited by examiner

*Primary Examiner*—Bret Hayes
(74) *Attorney, Agent, or Firm*—Pitts & Brittian, PC

(57) ABSTRACT

An encapsulated ballistic structure for limiting the transfer of impact force from a projectile. An encapsulant substantially encases and confines a core material. The core material absorbs a part of the compressive stress of a projectile impact. The encapsulant absorbs a part of the tensile stress of a projectile impact. The encapsulant is fabricated from an organic compound having a greater tensile strength than the tensile strength of the core material.

15 Claims, 2 Drawing Sheets

EFS

ENCAPSULATED BALLISTIC STRUCTURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to ballistic armor. More particularly, this invention pertains to ballistic armor formed from polymer encapsulated glass and polymer encapsulated ceramic materials.

2. Description of the Related Art

In designing ballistic armor, desired armor protection levels can usually be obtained if weight is not a consideration. In many armor applications other than personal armor, weight is not a critical factor, and thus traditional materials, such as steel, can offer some level of protection from ballistic projectiles and shell fragments. Steel armors also offer the advantage of low cost and can serve as structural members of the equipment into which they are incorporated.

However, in many other armor applications, there is a premium put on armor weight. Some areas of application where lightweight armor are desirable include ground combat and tactical vehicles, portable hardened shelters, helicopters, and various other aircraft used by the Army and the other military services. Another example of an armor application in need of reduced weight is personnel body armor worn by soldiers and law enforcement personnel.

In recent decades, certain hard ceramic materials have been developed for certain armor applications. These ceramic-based armors, such as alumina, boron carbide, silicon carbide, and titanium diboride ceramics provide the advantage of being lighter in mass than steel and provide ballistic stopping power comparable to steel. Thus, in applications in which having an armor design with the lowest possible weight is important, low specific gravity armor materials are highly desirable.

Ballistic ceramics are extraordinarily hard, strong in compression, and relatively light weight, making them efficient at eroding and shattering armor-piercing threats. However, ballistic ceramics often experience brittle fracture due to excessive tensile stresses on the back face of the armor body. After one impact of sufficient energy, a previously monolithic ceramic fractures extensively, leaving many smaller pieces and a reduced ability to protect against subsequent hits in the same vicinity. By reducing tensile stress within the ceramic armor body, the kinetic energy of the projectile can be absorbed completely within the projectile, e.g., ideally complete self-destruction at the surface of the armor body, or more typically, shattering of the ceramic while the projectile undergoes self-destruction as its kinetic energy is depleted to zero.

Conventional ceramic armor materials typically employ a laminated structure comprising a layer of ceramic material such as boron carbide and a layer of reinforced fabric such as Kevlar®. The ceramic layer typically faces the expected incoming projectiles and is typically covered with what is called a spall shield—a thin, flexible layer which is provided as the outer layer facing the incoming projectiles. This layer is typically either rubberized, or is constructed of ballistic nylon cloth, felt, or resin-impregnated glass fabric. The spall shield is designed to prevent ejection of high velocity fragments of ceramic or projectile particles subsequent to the impact by the projectile.

In the laboratory, ceramics show much higher performance in ballistic armor applications when their boundaries are heavily confined. The two key parameters are suppression of cracked tile expansion and putting the ceramic in an initial state of high compressive stress to delay or stop it from going into a state of tensile stress during impact. If the ceramic tile is not encased, the fractured pieces can easily move away from the locale of the impact, and residual protection is lost.

Snedeker et al., use a hybrid metal/ceramic approach in U.S. Pat. No. 5,686,689. Ceramic tiles are placed into individual cells of a metallic frame consisting of a backing plate and thin surrounding walls. A metallic cover is then welded over each cell, encasing the ceramic tiles. In U.S. Pat. No. 6,601,497, Ghiorse et al., describes wrapping a band of metal material around the perimeter of a ceramic tile so as to place the tile in a compressive state. Also, U.S. Pat. No. 4,739,690, issued to Moskowitz, teaches a spall shield for an armor plate wherein the spall shield contains an outer layer of plasticized resin.

BRIEF SUMMARY OF THE INVENTION

An encapsulated ballistic structure for limiting the transfer of impact force from a projectile is disclosed. According to one embodiment of the present invention, a core material for absorbing the impact of a projectile is provided. An encapsulant substantially encases and confines the core material. The encapsulant is fabricated from an organic compound having a greater tensile strength than the tensile strength of the core material.

Preferrably, the encapsulant precompresses the core material. Such precompression is accomplished by selecting a suitable encapsulant having a coefficient of thermal expansion greater than the coefficient of thermal expansion of the core material. The suitable encapsulant is then applied to the core material at a heated temperature and allowed to cool such that the encapsulant contracts relative to the core material, thereby applying compression to the core material.

Another embodiment provides a structural layer covering the encapsulant to provide structural stability and protection for the encapsulant and the core material. The encapsulant and the structural layer are configured such as to promote delamination of the portion of the structural layer disposed opposite the location of the anticipated projectile impact.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An encapsulated ballistic structure for limiting the transfer of impact force from a projectile is disclosed. The encapsulated ballistic structure, illustrated at 10 in the figures, includes a core material 12 and an encapsulant 14 substantially surrounding and confining the core material 12.

Figure 1:
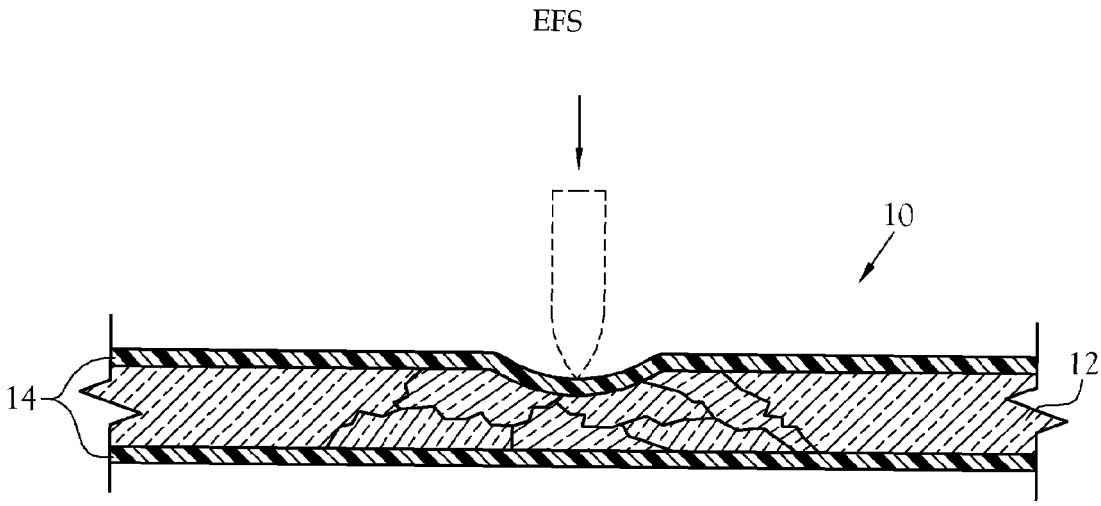
FIG. 1 is a cross-sectional view of an encapsulated ballistic structure constructed in accordance with various features of the present invention, showing a projectile deforming the encapsulant and fracturing the core material.

Referring to FIG. 1, the core material 12 is defined by a surface fabricated from a substance having hardness and compressive strength sufficient to substantially absorb at least a portion of the impact from a projectile. It is understood that the specific materials suitable for use in the core material 12 depends upon the mass, velocity, and impact characteristics of the projectile to be armored against. In one embodiment, the core material 12 is constructed from a material selected from the group consisting of glass, ceramics, and glass-ceramics. The core material 12 can also comprise a ceramic material selected from the group consisting of aluminum oxide, silicon carbide, boron carbide, titanium diboride, aluminum nitride, silicon nitride, tungsten carbide, and combinations thereof.

The ballistic structure or armor absorbing a portion of the impact force from a projectile such as a rifle round incorporates a core material 12 such as a ceramic. The core material 12 can vary in thickness, configuration, density and weight in order to enhance the projectile stopping power. Additionally, there is a cost versus weight trade off in certain applications, for example it is important that armor for personal use be lightweight, while armor for vehicle use can be of a heavier weight. More specifically, in deciding which core material ceramic should be used, hardness relative to the sonic velocity of a projectile may also be an important factor. Additionally, the density of the ceramic can be chosen to enhance the projectile stopping power. For example, in the instance of boron carbide having a density of less than about 2.49 grams per cubic centimeter, inferior shielding may result even at lower sonic velocities. Thus, the density is chosen above the stated limit to enhance the impact force absorption. Toughness of the ceramic core material 12 can also be useful, for example titanium dibroide is substantially metallic and useful against a heavy threat projectile such as a 105 mm long rod at a velocity of 5600 feet per second. However, titanium dibroide is not as effective as boron carbide for shielding against small arms. Accordingly, the core material 12 can be selected to accommodate an anticipated ballistic attack to enhance the effectiveness of the shielding.

Increasing the density of the ceramic will, as a general rule, enhance its shielding power, and density is also a variable in deciding which core material will be used against anticipated ballistic attacks. In certain applications such as airships and body armor, as mentioned briefly above, lightweight ceramics are preferable. However in vehicle armor applications weight is not as critical. Moreover, cost is one of the variables used in selecting the core material 12, and in this regard boron carbide powders cost about USD $26.00 per pound and must be hot pressed at 2230° C. at 2000 psi for optimization. Alumina costs USD $2.00 per pound and is sintered at 1600° C. in approximately atmospheric pressure, making it more desirable in situations where it is effective for small arms fire. Finally, cross sectional thickness is also a variable considered in the ballistic structure. Thicker cross sections of AL203 are required at 3.9 grams per cubic centimeter versus thinner cross sections of boron carbide at 2.5 grams per cubic centimeter. In certain silicon carbide having a density of 3.2 grams per cubic centimeter serve to effectively stop a projectile or round at a similar thickness but at a lower cost. Those skilled in the art may recognize other substances suitable for use in the core material 12 encased in an encapsulant fabricated preferable from an organic compound having a greater tinsel strength than the tinsel strength of the core material 12.

In the illustrated embodiment of FIG. 1, the encapsulant 14 is a layer fabricated from an organic compound having a tensile strength greater than the tensile strength of the core material 12. It is understood that the specific materials suitable for use in the encapsulant 14 is a function of the mass, velocity, and impact characteristics of the projectile to be armored against. In typical fabrication, the encapsulant 14 is a polymer-based non-metal. In more discrete embodiments, the encapsulant 14 is fabricated from the group consisting of silicon based polymers, plasticized polyvinyl acetal resins, plasticized polyvinyl butyral resins, acrylic resins, and polycarbonate resins.

Figure 2:
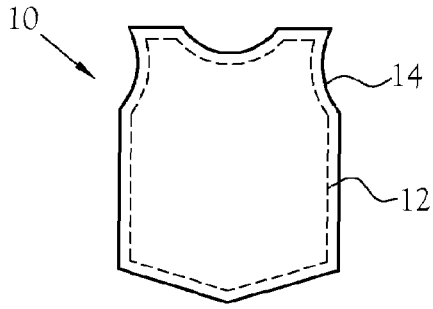
FIG. 2 is a top view of the entire encapsulated ballistic structure of FIG. 1.

FIG. 2 illustrates a top view of one embodiment of the encapsulated ballistic structure 10 configured for serving as a protective vest. Referring to FIG. 2, the encapsulant 14 is configured to substantially surround and enclose the core material 12. In one embodiment, the encapsulant 14 precompresses the core material 12. In fabrication of the encapsulated ballistic structure 10, such precompression is accomplished by selecting a suitable encapsulant 14 having a coefficient of thermal expansion greater than the coefficient of thermal expansion of the core material 12. Both the core material 12 and the encapsulant 14 are heated to a first temperature, upon which the encapsulant 14 expands relative to the core material 12. While heated to the first temperature, the core material 12 is then substantially encapsulated within the encapsulant 14. Finally, both the core material 12 and the encapsulant 14 are cooled to a second temperature, at which point the encapsulant 14 contracts relative to the core material 12, thereby applying compression to the core material 12.

The encapsulate 14 and the core material 12 are chosen such that they can be heated enough to establish a good adhesive bond without damaging either the core material 12 or the encapsulate. By increasing the atmospheric pressure around the encapsulate 14 and the core material 12 during heating at the time of fabrication, lower temperatures can be used during the heating which may reduce any damage to the encapsulant 14 and core material 12 during fabrication. Normally this is accomplished by an autoclaving.

Absent precompression, at least simple intimate contact between the core material 12 and the encapsulant 14 is needed. As is shown in FIG. 1, it is appreciated that, upon subjection of the core material 12 to impact forces resulting from a projectile, fracture of the core material 12 is contemplated. In this respect, the intimate contact between the core material 12 and the encapsulant 14 provides a means for containing debris resulting from fracture of the core material 12, such as, for example, fracture resulting from projectile impact. Such debris containment serves to retain the various fractured pieces of the core material 12 substantially within the original configuration of the core material 12, thereby improving the multi-hit performance and field durability of the encapsulated ballistic structure 10. In embodiments in which the encapsulant 14 precompresses the core material 12, the encapsulant 14 further serves to increase the penetration resistance of the core material 12.

Figure 3:
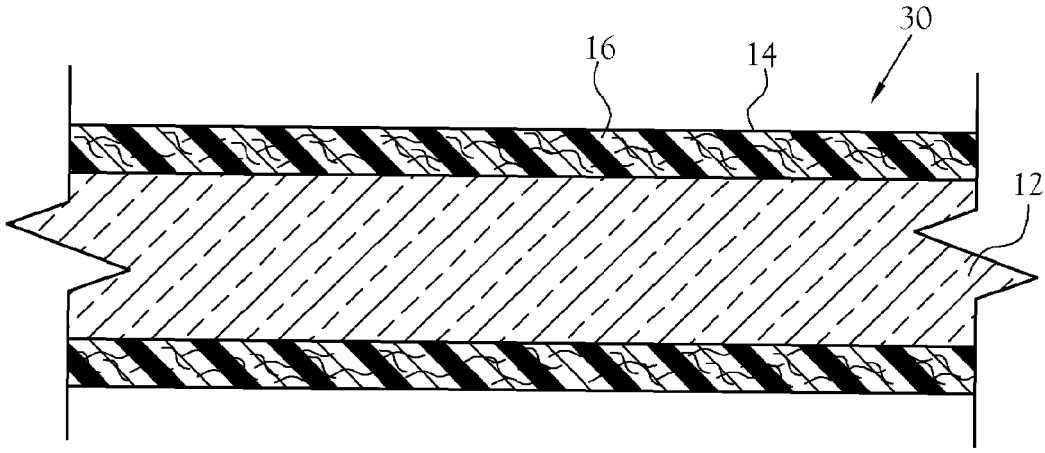
FIG. 3 is a cross-sectional view of another embodiment of the encapsulated ballistic structure, showing the inclusion of reinforcing fibers within the encapsulant.

The maximum compressive stress the encapsulant 14 imparts to the encapsulated core material 12 is related to the yield stress of the encapsulant 14. Specifically, the higher the yield stress of the encapsulant 14, the less impact stress is imparted to the core material 12. FIG. 3 illustrates another embodiment of the encapsulated ballistic structure 30. As shown in FIG. 3, the yield strength and coefficient of thermal expansion of the encapsulant 14 is increased through the addition of short reinforcing fibers 16 within the encapsulant 14. In the illustrated embodiment, the encapsulant 14 serves as a matrix for suspending a plurality of reinforcing fibers 16 within the organic compound of the encapsulant 14. In this configuration, the suspension of reinforcing fibers 16 within the encapsulant 14 serves to increase the yield strength of the encapsulant 14, thereby decreasing the potential for impact forces being imparted to the core material 12. In one embodiment, the reinforcing fibers 16 further serve to increase the effective mean coefficient of thermal expansion of the encapsulant 14, thereby increasing the potential of the encapsulant 14 for compression loading on the core material 12. The reinforcing fibers are typically short staple or chopped metallic fibers constructed from a metal of relatively high tensile strength, such as steel, titanium, aluminum, or some combination thereof. However, those skilled in the art will recognize that the reinforcing fibers 16 can be fabricated from numerous metallic and non-metallic substances and alloys without departing from the spirit and scope of the present invention. To this extent, it is appreciated that long or short carbon fibers can be used to accomplish the reinforcing fibers 16 of the present invention.

Figure 4:
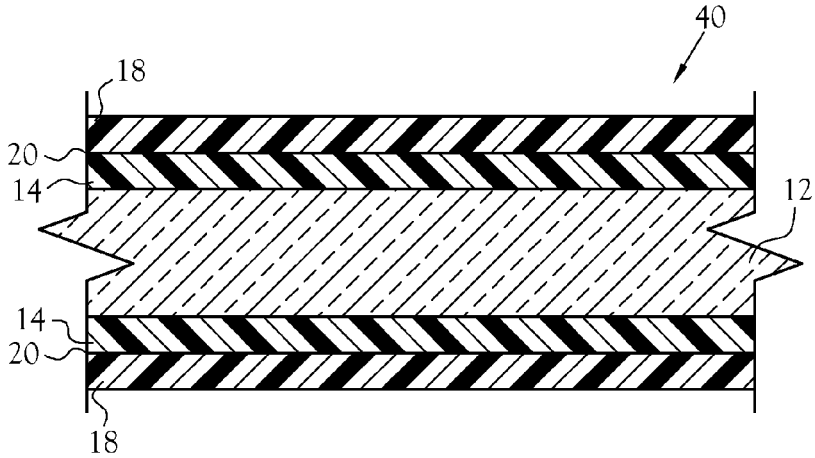
FIG. 4 is a cross-sectional view of another embodiment of the encapsulated ballistic structure, showing the inclusion of a structural layer surrounding the encapsulant.

FIG. 4 illustrates another embodiment of the encapsulated ballistic structure 40 of the present invention. In the embodiment of FIG. 4, a structural layer 18 covers the encapsulant 14 to provide structural stability and further protection for the encapsulant 14 and the core material 12. In typical fabrication, the structural layer 18 is constructed from a material selected from the group consisting of glass, ceramics, and glass-ceramics. More specifically, the core material 12 can be selected from the group consisting of aluminum oxide, silicon carbide, boron carbide, titanium diboride, aluminum nitride, silicon nitride, tungsten carbide, and combinations thereof. However, those skilled in the art will recognize numerous other substances suitable for use in the core material 12.

Figure 5:
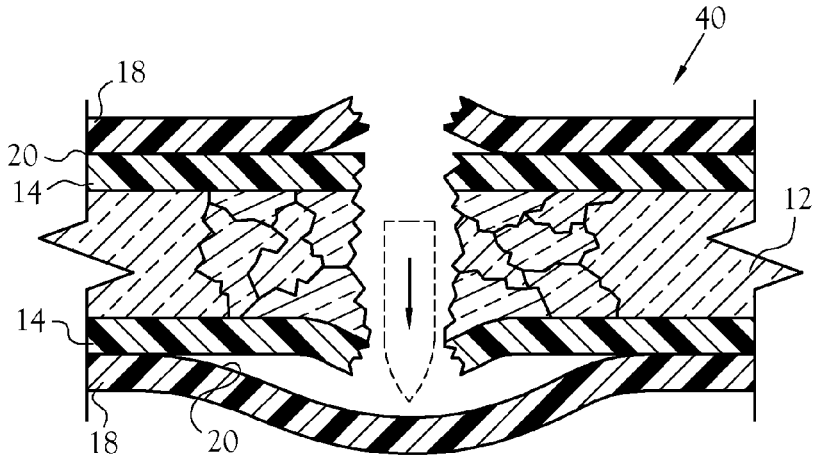
FIG. 5 is a cross-sectional view of the encapsulated ballistic structure of FIG. 4, showing a projectile piercing the encapsulant and core material layers and deforming the structural layer covering the tensile surface of the encapsulant.

FIG. 5 illustrates a cross-sectional view of the encapsulated ballistic structure 40 of FIG. 4, showing a projectile piercing upper structural layer 18 and the encapsulant 14 and core material 12, layers and deforming the portion of the lower structural layer 18 covering the tensile surface of the encapsulant 14. Referring to FIGS. 4 and 5, the structural layer 18 is configured to substantially cover the encapsulant 14. In the present embodiment, the encapsulant 14 and the structural layer 18 are configured such as to promote delamination of the portion of the structural layer 18 disposed opposite the anticipated projectile impact. In one embodiment, the surface characteristics of the encapsulant 14 and the structural layer 18 are designed to allow the structural layer 18 to slide against the encapsulant 14. In another embodiment, a delamination layer 20 is disposed between the encapsulant 14 and the structural layer 18. In more discreet embodiments, the delamination layer 20 is constructed from a fabric coated for non-stick properties and perforated to promote partial bonding. However, those skilled in the art will recognize that resin starved sheets, plastic non-stick layers, metal foils, and other suitable materials exist to accomplish the delamination layer 20 without departing from the spirit and scope of the present invention.

Figure 6:
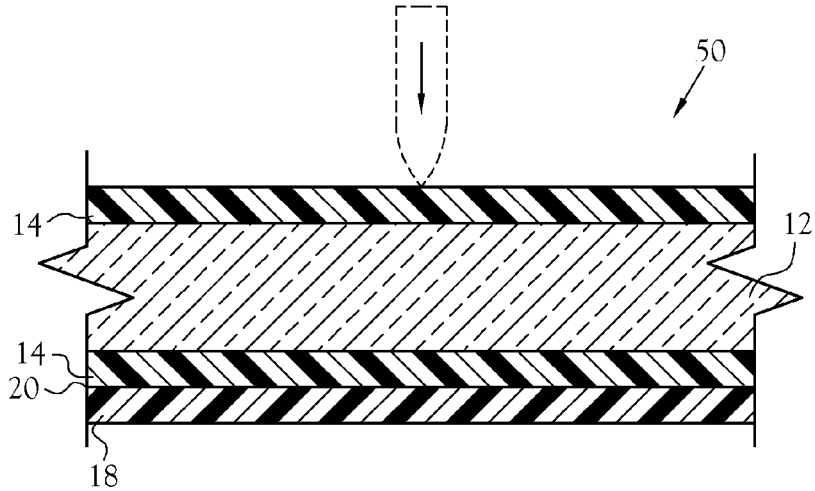
FIG. 6 is a cross-sectional view of another embodiment of the encapsulated ballistic structure, showing the inclusion of a structural layer covering the tensile surface of the encapsulant.

FIG. 6 illustrates another embodiment of the encapsulated ballistic structure 50, in which a structural layer 18 is provided to cover only that portion of the encapsulant 14 opposite the anticipated projectile impact. As illustrated in FIGS. 5 and 6, the delamination of the portion of the structural layer 18 disposed opposite the anticipated projectile impact serves to distribute force resulting from impact to the encapsulated ballistic structure 50 more evenly over the structural layer 18. Further, interlaminar delamination serves to reduce shear loading of the structural layer 18 resulting from shear or tensile failure of the encapsulant 14. Referring to FIG. 6, in this configuration, the encapsulated ballistic structure 50 is constructed to provide suitable ballistic protection, while reducing the overall weight of the encapsulated ballistic structure 50. It will be noted that in the illustrated embodiment of FIG. 4, the structural layer 18 is configured to substantially surround the encapsulated ballistic structure 40. In this configuration, a portion of the structural layer 18 is disposed to cover each side of the encapsulant 14, thereby rendering substantially similar ballistic protection from projectiles impacting either side of the encapsulated ballistic structure 40.

It is found that Kevlar or Dyneema are suitable backing materials for the structural layer 18 since these materials serve to stop fragments of the ceramic core material broken upon impact with a projectile. Preferably, there should be a bond between the core material 12 and the backing structural layer 18. The encapsulant 14 is chosen such that its thermal expansion coefficient promotes good adhesion to the core material 12 for environmental temperatures which may range from −40° C. to +50° C.

In the preferred embodiment, the encapsulant material can be fabricated from carbon, which serves to enclose a ceramic core material such that the composite structure can protect the ceramic during normal wear and movement, while holding the core material 12 together for absorbing the impact of a ballistic event. Thus the encapsulant 14 enhances better core material 12 or ceramic erosion and better enables the structure to provide shielding for multiple hit events.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A ballistic structure for absorbing a portion of the impact force from a projectile, said ballistic structure comprising:

a core material for absorbing the impact of the projectile; and an encapsulant substantially encasing said core material, said encapsulant being fabricated from an organic compound having a greater tensile strength than the tensile strength of said core material, said encapsulant being configured to compress said core material to increase the penetration resistance of said core material during impact by the projectile.

2. The ballistic structure of claim 1 wherein said core material is selected from the group consisting of glass, ceramics, and glass-ceramics.

3. The ballistic structure of claim 1 wherein said core material is selected from the group consisting of boron carbide, silicon carbide, aluminum oxide, aluminum nitride, silicon nitride, tungsten carbide, and titanium diboride.

4. The ballistic structure of claim 1 wherein said encapsulant is selected from the group consisting of silicon based polymers, plasticized polyvinyl acetal resins, plasticized polyvinyl butyral resins, acrylic resins, and polycarbonate resins.

5. The ballistic structure of claim 1 further including a structural layer for providing structural support to said encapsulant and said core material, said structural layer being configured to cover at least a portion of said encapsulant.

6. The ballistic structure of claim 5 further including a delamination layer disposed between said encapsulant and said structural layer for promoting delamination of at least a portion of said structural layer.

7. A method for constructing ballistic armor for limiting the transfer of impact force from a projectile, said method comprising the steps of:

(a) providing a core material for absorbing the impact of the projectile, and providing an organic compound having a coefficient of thermal expansion greater than the coefficient of thermal expansion of said core material;

(b) heating said core material and said organic compound to a first defined temperature;

(c) substantially enclosing said core material within said organic compound; and (d) allowing said core material and said organic compound to cool to a second defined temperature, such that said core material is subjected to compression as said organic compound thermally contracts in response to cooling.

8. The method of claim 7 wherein said core material is selected from the group consisting of glass, ceramics, and glass-ceramics.

9. The method of claim 8 wherein said organic compound is selected from the group consisting of silicon based polymers, plasticized polyvinyl acetal resins, plasticized polyvinyl butyral resins, acrylic resins, and polycarbonate resins.

10. The method of claim 7 wherein said core material is selected from the group consisting of boron carbide, silicon carbide, aluminum oxide, aluminum nitride, silicon nitride, tungsten carbide, and titanium diboride.

11. The method of claim 10 wherein said organic compound is selected from the group consisting of silicon based polymers, plasticized polyvinyl acetal resins, plasticized polyvinyl butyral resins, acrylic resins, and polycarbonate resins.

12. The method of claim 7 wherein said organic compound is selected from the group consisting of silicon based polymers, plasticized polyvinyl acetal resins, plasticized polyvinyl butyral resins, acrylic resins, and polycarbonate resins.

13. A ballistic structure for limiting the transfer of impact force from a projectile, said ballistic structure comprising:

a core material for absorbing the impact of the projectile;

an encapsulant substantially encasing said core material, said encapsulant being fabricated from an organic compound having a greater tensile strength than the tensile strength of said core material; and a plurality of fibers dispersed throughout said encapsulant, said plurality of fibers having a greater tensile strength than the tensile strength of said encapsulant.

14. The ballistic structure of claim 13, wherein said core material is selected from the group consisting of boron carbide, silicon carbide, aluminum oxide, aluminum nitride, silicon nitride, tungsten carbide, and titanium diboride, and wherein said organic compound is selected from the group consisting of silicon based polymers, plasticized polyvinyl acetal resins, plasticized polyvinyl butyral resins, acrylic resins, and polycarbonate resins.

15. The ballistic structure of claim 13 further including:

a structural layer for providing structural support to said encapsulation and said core material, wherein said structural layer is configured to promote delamination of at least a portion of said structural layer; and a delamination layer disposed between said encapsulant and said structural layer for promoting delamination of at least a portion of said structural layer.

* * * * *